United States Patent [19]

Maddox

[11] Patent Number: 4,930,779

[45] Date of Patent: Jun. 5, 1990

[54] APPARATUS FOR SELECTING RANDOM NUMBERS

[76] Inventor: Albert F. Maddox, 5725 Sands Point, Lakeland, Fla. 33809

[21] Appl. No.: 329,206

[22] Filed: Mar. 27, 1989

[51] Int. Cl.[5] ..... A63F 9/00

[52] U.S. Cl. ..... 273/144 B

[58] Field of Search ..... 273/144 R, 144 A, 144 B

[56] References Cited

FOREIGN PATENT DOCUMENTS 1122421 1/1962 Fed. Rep. of Germany ... 273/144 B 686474 3/1965 Italy ..... 273/144 B

*Primary Examiner*—Anton O. Oechsle

*Attorney, Agent, or Firm*—Dominik, Stein, Saccocio, Reese, Colitz & Van Der Wall

[57] ABSTRACT

An improved apparatus for the selection of a predetermined quantity of a plurality of random numbers for use in the playing of a lottery game comprising a plurality of numbered balls and a container for the balls. The container is formed of a base, a hollow cover secured to the upper surface of the base and an intermediate member secured between the base and cover at an intermediate location. The intermediate member is formed with a slide extending downwardly from its read portion to its forward portion which includes a trough for supporting the predetermined quantity of balls whereby when inverted, the balls will move to the upper extent of the cover and when reverted the balls will roll down the slide to the lower extent of the cover onto the base with the preselected quantity of balls being randomly received and supported in the trough for reading by the participant of the lottery game. The trough may extend horizontally or generally vertically. The trough may be supported by the cover or the base.

9 Claims, 3 Drawing Sheets

APPARATUS FOR SELECTING RANDOM NUMBERS

BACKGROUND OF THE INVENTION

This invention relates to an improved apparatus for selecting random numbers and, more particularly, to random number selection apparatus including a predetermined quantity of numbered balls and a container for the balls, the container having a base, a transparent cover with a magnifying section and an intermediate portion containing a slide and a trough so that when in an erect orientation a predetermined number of balls will rest in the trough with the remainder of the balls therebeneath but, when inverted, all of the balls will be randomly located above the trough whereby, when reverted, the container will allow the balls to roll down the slide to the bottom of the container with the preselected number of balls entering the trough for being read through the magnifying section.

DESCRIPTION OF THE BACKGROUND ART

An increasing number of states are enacting lotteries. In lotteries, a participant pays a particular amount of money and selects a series of numbers, normally three (3) or six (6), depending on the state and the nature of the particular lottery game. If the numbers selected by the participant match those determined by the state, the participant wins money, normally a large amount.

In playing the lottery, the participant must select a predetermined quantity of numbers, as, for examples, six (6) from numbers one (1) through forty-nine (49). In a smaller game, three single digit numbers are selected from thirty (30), numbers zero (0) through nine (9) three times.

The selection of numbers often causes problems for the participant. The problems are is increased when the participant plays several cards at the same time. The numbers selected may be arbitrary, or, more likely, a lucky or special number such as a birthday, anniversary, phone number, address or the like. When playing several cards, the participant often runs out of lucky or special numbers to play. As a result, a large variety of devices have been configured to assist the participant in the selection of their lottery numbers. Most such known devices, however, are not necessarily attractive in appearance. They are often difficult and complex to utilize and read.

Typical of such known devices are those disclosed in U.S. Pat. No. 3,289,321 to Sussman and in U.S. Pat. No. 4,530,503 to Rice. These devices employ ball-holding tubes having, at one end, an enlarged portion for constituting a reservoir for the numbered balls. When inverted, the balls are entirely within the reservoir. When reverted, a random preselected number of balls fall within the tube. Similar structures are disclosed in foreign patents including French Patent No. 2382-059 filed Feb. 28, 1977 in the name of Saddier; German Patent No. 26 30 020 published Dec. 1, 1978 in the name of Jung; French Patent No. 2428-877 filed June 13, 1978 in the name of Coste and German Patent No. DE 36 03 302 A1 filed Apr. 2, 1986 in the name of Drignath.

In addition to the foregoing, spherical balls within devices of different shapes are disclosed in U.S. Pat. No. 2,799,506 to Nord; U.S. Pat. No. 4,280,702 to Tremblay as well as in foreign patents such as French Patent No. 1.225.047 to Brondy and German Patent No. 2431-158 filed July 11, 1978 in the name of Fehr.

Lastly, variations in the above constructions are disclosed in U.S. Pat. No. 4,403,775 to Chaput wherein numbers on tubes are rendered visible through light colored balls when contrasted against dark colored balls. Lastly, U.S. Pat. No. 4,533,143 to Albright discloses the use of cubes which are suspended in a transparent fluid wherein the cubes may be moved randomly against a commercial reading area.

As illustrated by the great number of known devices as well as prior patents, efforts are continuously being made in an attempt to improve random number selection devices which function more efficiently, conveniently, reliably and economically. None of these previous efforts, however, provides the benefits attendant with the present invention. Additionally, prior devices do not suggest the present inventive combination of component elements as disclosed and claimed herein. The present invention achieves its intended objectives, purposes and advantages over the prior art devices through a new, useful and unobvious combination of component elements with the use of a minimum number of functioning parts, at a reduced cost to manufacture, and by employing only readily available materials.

Therefore, it is an object of this invention to provide an improved apparatus for the selection of a predetermined quantity from a plurality of random numbers for use in the playing of a lottery game comprising a plurality of numbered balls; and a container for the numbered balls formed of a base, a hollow cover secured at its lower edge to the upper surface of the base and an intermediate member secured between the base and cover at an intermediate location, the intermediate member being formed with an angled slide extending from an elevated rear portion to a lower forward portion, the forward portion being formed with a trough for supporting a predetermined quantity of balls whereby when inverted, the balls will move to the upper extent of the cover and when reverted the balls will roll down the slide to the lower extent of the cover onto the base with the preselected quantity of balls being randomly received and supported in the trough for being read by the participant of the lottery game.

It is another object of this invention to randomly select numbers for a lottery.

It is a further object of the invention to present a neat and appealing appearance for a gaming device.

Lastly, it is an object of the present invention to facilitate the reading of randomly selected numbers for use in a lottery.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention may be incorporated into an improved apparatus for the selection of a predetermined quantity from a plurality of random numbers for use in the playing of a lottery game. The apparatus comprises a plurality of numbered balls; and a container for the numbered balls. The container is formed of a base, a hollow cover secured at its lower edge to the upper surface of the base and an intermediate member secured between the base and cover at an intermediate location. The intermediate member is formed with an angled slide extending from an elevated rear portion to a lower forward portion, the forward portion being formed with a trough for supporting a predetermined quantity of balls whereby when inverted, the balls will move to the upper extent of the cover and when reverted the balls will roll down the slide to the lower extent of the cover onto the base with the preselected quantity of balls being randomly received and supported in the trough for being read by the participant of the lottery game. The apparatus may further include a strip lens formed in one side of the cover for facilitating the reading of numbers in the trough, means coupling the rear edge of the intermediate member to the cover, and support means securing the intermediate member to the base. The support means is transparent and curved along its length to conform with and contact an adjacent interior surface of the cover. The trough may retain the preselected balls horizontally and may include stoppers on the opposite ends of the trough. The trough may retain the preselected balls generally vertically.

In addition, for the purposes of summarizing the invention, the invention may also be incorporated into apparatus for the selection of a predetermined quantity from a plurality of random numbers for use in the playing of a lottery game comprising a plurality of numbered balls and a container for the numbered balls formed of a base; a hollow transparent cover with a strip lens secured at its lower edge to the upper surface of the base with a strip lens formed horizontally therein; an intermediate member within the cover; support means coupling the intermediate member to the base, the intermediate member being formed with a slide extending downwardly from a rear portion to a forward portion, the forward being formed with an uncovered, horizontal trough for supporting the predetermined quantity of balls whereby when inverted, the balls will move to the upper extent of the cover and when reverted, the balls will roll down the slide to the lower extent of the cover onto the base with the preselected quantity of numbered balls being randomly received and supported in the trough for reading by the participant of the lottery game.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the ar that the conception and the disclosed specific embodiments may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

Similar referenced characters refer to similar parts throughout the several Figures.

DETAILED DESCRIPTION OF THE INVENTION

Figure 1:
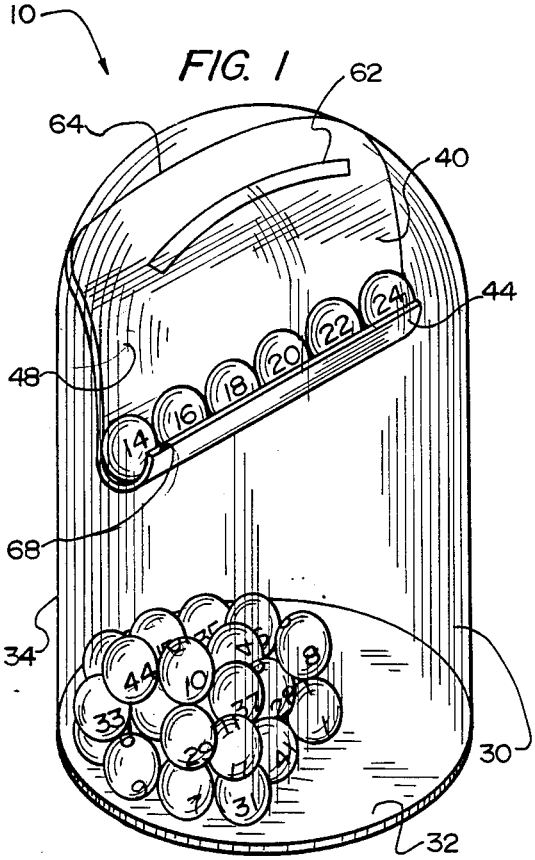
FIG. 1 is a perspective illustration of the number selecting apparatus constructed in accordance with the principles of the present invention.

As can be seen in FIGS. 1 through 4, there is shown apparatus 10 constituting the primary embodiment of the instant invention. The primary embodiment includes a container 12 and a plurality of balls 14, 16, 18, 20, 22, 24, 26, etc. The balls 14, etc. are located within the container 12, the majority of which are normally located in a lower or reservoir area 30, only some of which are shown. A preselected random number of balls 14 through 24 are located at an intermediate location for reading by the participant of the lottery game.

The container 12 is formed of three (3) major components, the base 32, constituting the lower extent of the container 12. The second part is the cover 34, a hollow transparent member secured at its lower edge 36 to the upper surface 38 of the base 32. The third part of the container is the intermediate member 40 secured within the space between the cover 34 and the base 32. The intermediate member 40 is provided with a trough 44 for receiving and supporting the preselected number of randomly selected balls 14 through 24 from within the container 12.

The balls are all spherically shaped, rigid members, each provided with a specific number to distinguish each ball from every other ball. In most lottery games, six (6) numbers are to be selected and, consequently, six (6) balls from the reservoir 30 are to be randomly received and supported at any one time in the trough 44 of the intermediate member 40. The six (6) balls on the trough 44 represent the six (6) numbers to be selected by the lottery participant. Each ball has permanently printed thereon in legible form distinct numbers from one (1) to forty-nine (49) inclusively. Each number may be printed and appear at a plurality of locations on each ball for ease of reading from any direction. The orientation of the balls on the trough 44 is thus rendered inconsequential.

Figure 2:
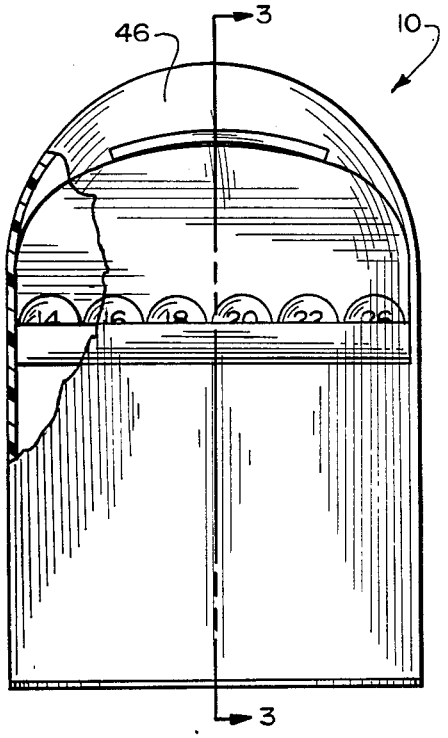
FIG. 2 is an elevational view of the apparatus shown in FIG. 1.
Figure 3:
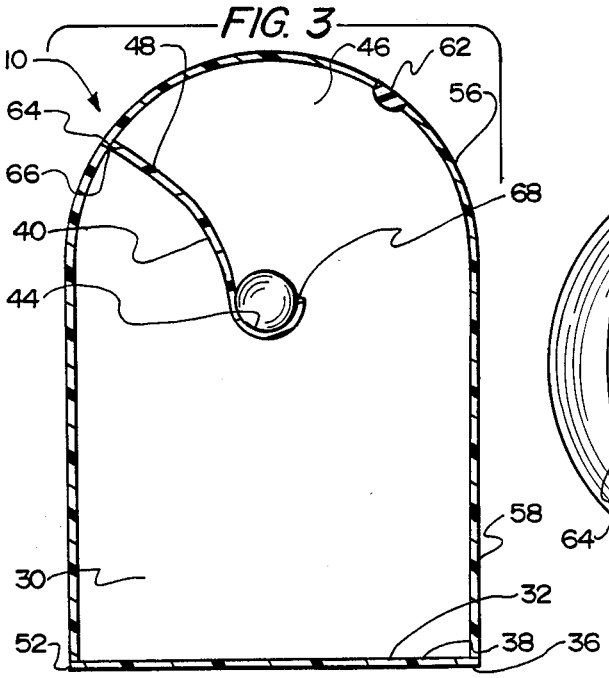
FIG. 3 is a sectional view of the apparatus shown in FIGS. 1 and 2 taken along line 3-3 of FIG. 2.
Figure 4:
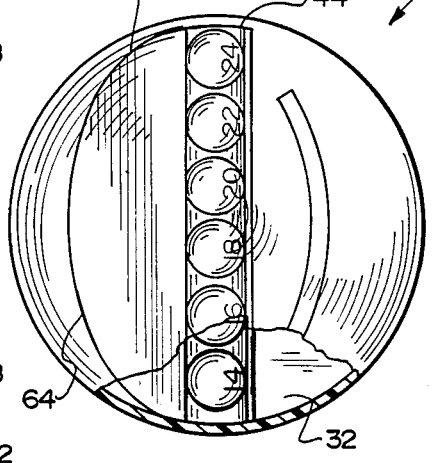
FIG. 4 is a plan view of the apparatus shown in the prior Figures.

The balls are adapted to be normally located in the lower or reservoir area 30 of the container 12 when the apparatus 10 is in the rest position as shown in FIGS. 1, 2 and 3. When, however, the apparatus 10 is inverted, all of the balls will move under the influence of gravity to the upper area 46 of the container 12 which is now in a lower orientation. The trough 44 will also be evacuated of balls. Upon returning the apparatus 10 to the erect position of FIGS. 1 through 3, the balls will randomly roll down the slide 48 intermediate member 40 to the trough 44 with six (6) random numbers positioning themselves on the trough 44. The participant may now read such numbers on the balls on the trough 44 and make his selection of numbers for the lottery game.

The base 32 of the container 12 is rigid with the lower surface 52 adapted to rest on a table, desk or the like. The base 32 may be transparent, translucent or opaque in as much as the reading of the numbers within the container 12 is done through the cover 34 rather than through the base 32. The upper surface 38 of the base 32 has a peripheral extent adapted to receive the lower edge 36 of the cover 34 in a permanent relationship to seal the balls within the container. Conventional adhesive or cohesive bonding, preferably through an adhesive, effects the coupling.

The upper component of the container 12, the cover 34, is formed of a transparent material, its upper extent 56 is in a dome-like, hemispherical configuration continuing downwardly into a lower extent 58 in a cylindrical configuration. The cover 34 is thus preferably hemispherical in shape with tubular lower walls between its hemispherical upper extent and its lower extent which includes the area of contact and securement to the base 32.

Located in one wall of the cover 34 facing the balls to be read is a molded-in, contoured area, generally rectangular in configuration but curved to conform with the cover. The curvature of this area is preferably convex in cross-section to thereby constitute a lens 62 in a strip essentially equal to the length of the trough 44 and the balls to be read. Note FIG. 3 in particular. In this manner, the participant can more readily see the magnified numbers on the balls in the trough 44 which are to be selected and played.

The third component of the container is the intermediate member 40. The intermediate member 40 has an elevated ovate or generally elliptical rear portion 64 of a shape to conform with the interior surface 66 of the cover 34. The intermediate member 40 may be readily joined with adhesive, or otherwise adhered or cohered, to the cover 34 as seen in the various figures. The lower forward edge 68 of the intermediate member 40 is contoured with a trough for receiving and supporting random balls as they move by rolling, under the influence of gravity, from the upper area 46 of the container 12 t the reservoir 30 during the inversion and reversion of the apparatus 10. The balls in the trough 44 will be held in an elevated location above the reservoir 30 for optimum reading.

The trough 44 is preferably formed as a smooth continuing flow from the slide region 70 of the intermediate member 40 as it is shaped downwardly and then upwardly finally terminating at the forward edge 68 thus providing a surface having a semicircular curvature 70 of a size substantially the same as that of the balls. By having the upper portion of the trough 44 uncovered, slight discoloration of the trough material will not cause difficulties in the reading of the numbers by the participant.

From edge to edge, the trough 44 is of a length essentially equal to or slightly greater than the sum of the diameters of the balls to be received therein. This is equivalent to the space between the inner surfaces 66 of the cover 34 at the region spanned by the trough. When rolling down the slide, the balls present an esthetic appearance to the participant or other viewers.

The materials of the balls and base 32 are not as important as that of the constituent elements of the cover 34 and intermediate member 40. Specifically, the base 32 and balls may be of a transparent or opaque material so long as they are hard and durable for long life of the apparatus 10. The color of the balls, however, should be such as to visually contrast with the numbers thereon for ease of reading by the participant. The materials of the cover 34 and intermediate member 40 are preferably of a hard, rigid plastic which is and remains transparent over a long life. Typical materials are polypropylene and high density polyethylene. In this manner, the numbers on the balls can be read through the cover 34 from any location. The location of the strip lens 62 facing the balls in the trough 44, however, further minimizes the problem of reading the balls since the participant will only be looking through the strip lens 62 directly to the balls and not through supplemental layers of transparent material which would otherwise occur when the balls are encased in a transparent tube as in the prior art.

Figure 5:
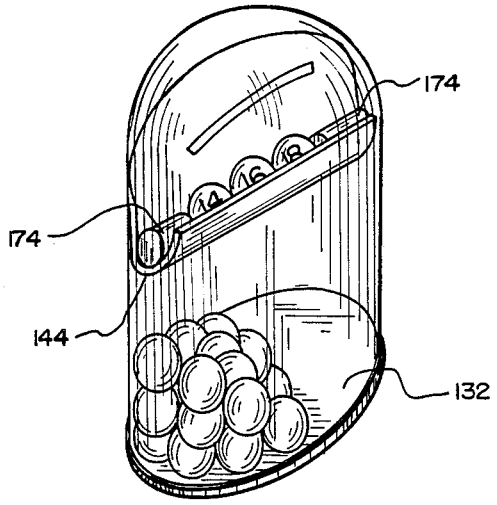
FIGS. 5 and 6 are perspective illustrations of alternate embodiments of the invention.
Figure 6:
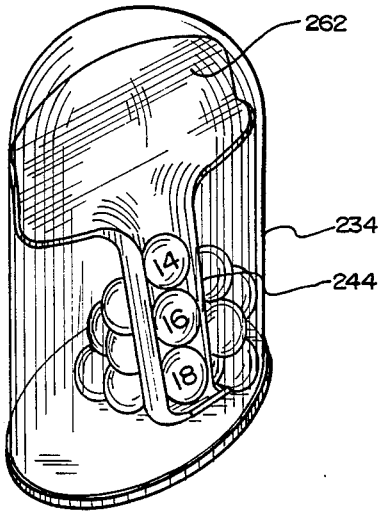

FIGS. 5 and 6 illustrate alternate embodiments of the present invention. In the FIG. 5 embodiment, the trough 144 is of a shorter extent in the horizontal direction, half the size of that of the primary embodiment, being blocked by tabular edge spacers 174 of equal size for symmetry. The trough 144 thus accommodates but three (3) balls 0, 1, 2 rather than the six (6) balls of the primary embodiment. This is for those lotto games where three (3) single digit numbers are selected from thirty (30) balls 0, 1, 2, 3, etc. rather than the forty-nine (49) numbers of the primary embodiment. As a result, a lesser number of balls is utilized than in the primary embodiment, and the apparatus may be proportionately smaller. Those balls utilized are from zero (0) to nine (9) with three (3) each of such groupings of balls. This is a total of thirty (30) balls. The resulting three (3) single digit members may be identical with, or different from, each other.

The FIG. 6 embodiment is similar to the FIG. 5 embodiment except that the trough 244 is contoured to support the three (3) selected balls in an angled orientation more vertical than horizontal as in the prior embodiments. The three (3) selected balls 6, 7, 8, 9, etc. are located one generally above the other in an orientation slightly off-set backwardly from the vertical. The orientation is generally vertical but off-set rearwardly. In this third embodiment, like the first two embodiments, the balls to be read are located on a trough rather than in a transparent tube for ease of reading. In this alternate third embodiment, the strip lens 262 portion of the cover 234 is located more vertically than horizontally in the cover for ease of reading of balls. The strip lens orientation corresponds to the orientation of the balls on the trough 244.

Figure 7:
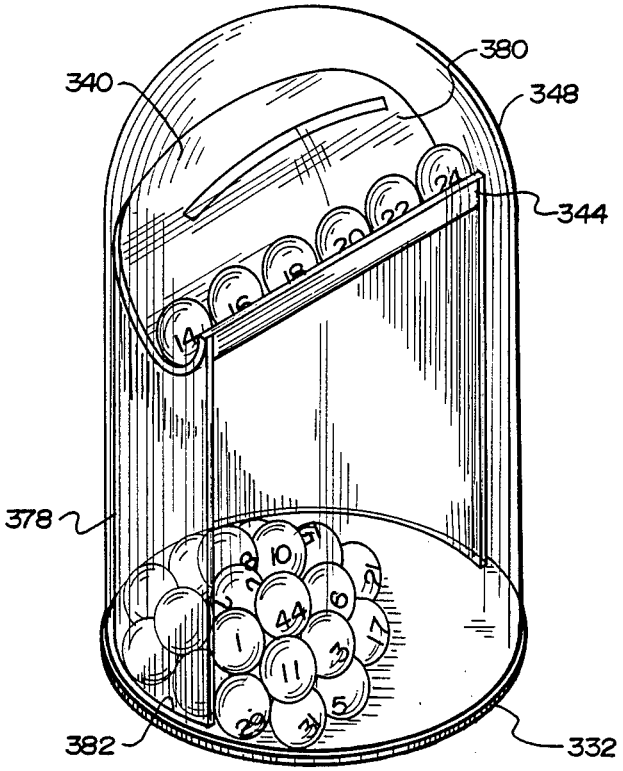
FIG. 7 is a perspective illustration of yet a further embodiment of the invention.

The FIG. 7 embodiment includes a modified support arrangement for the intermediate member 340. In the prior embodiments, the intermediate member is secured to the cover 34, 134 and 234. In the FIG. 7 embodiment, the intermediate member 340 is secured to the base 332 by a supporting structure 378. The supporting structure 378 is curved along its length to conform with and contact an adjacent interior surface of the cover inside of which it is located. It is coupled at its upper end 380 to the intermediate member 340 and at its lower end 382 to the base 332 as through a suitable adhesive. The intermediate member includes a slide 348 and a trough 344 which could take the shape of that of any of the prior embodiments. Such supporting structure 378 facilitates the assembly of the container.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described, what is claimed is:

1. Apparatus for selection of a predetermined quantity from a plurality of random numbers for use in the playing of a lottery game comprising:

a plurality of numbered balls; and a container for the number balls formed of a base, a hollow cover secured at its lower edge to the upper surface of the base and an intermediate member secured horizontally between the base and cover at an intermediate location, the intermediate member being formed with an angled slide extending from an elevated rear portion to a lower forward portion, the slide being of a size to simultaneously support a plurality of balls, the forward portion being formed with a trough for supporting a predetermined quantity of balls in a horizontal orientation whereby when inverted, the balls will move to the upper extent of the cover and when reverted the balls will roll down the slide to the lower extent of the cover onto the base with the preselected quantity of balls being randomly received and supported in the trough for being read by the participant of the lottery game.

2. The apparatus as set forth in claim 1 and further including a strip lens formed in one side of the cover for facilitating the reading of numbers in the trough.

3. The apparatus as set forth in claim 1 and further including means coupling the rear edge of the intermediate member to the cover.

4. The apparatus as set forth in claim 1 and further including support means securing the intermediate member to the base.

5. The apparatus set forth in claim 4 wherein the support means is transparent and curved along its length to conform with and contact an adjacent interior surface of the cover.

6. The apparatus as set forth in claim 1 wherein the trough retains the preselected balls horizontally.

7. The apparatus as set forth in claim 6 and further including stoppers on the opposite ends of the trough.

8. The apparatus as set forth in claim 1 wherein the trough retains the preselected balls generally vertically.

9. Apparatus for the selection of a predetermined quantity from a plurality of random numbers for use in the playing of a lottery game comprising a plurality of numbered balls and a container for the numbered balls formed of:

a base;

a hollow transparent cover secured at its lower edge to the upper surface of the base with a strip lens formed horizontally therein;

an intermediate member within the cover;

support means coupling the intermediate member to the base, the intermediate member being formed with a slide extending downwardly from a rear portion to a forward portion, the forward portion being formed with an uncovered horizontal trough for supporting the predetermined quality of balls whereby when inverted, the balls will move to the upper extent of the cover and when reverted, the balls will roll down the slide to the lower extent of the cover onto the base with the preselected quantity of numbered balls being randomly received and supported in the trough for reading by the participant of the lottery game.

* * * * *